US010072477B2

(12) United States Patent
Cooper et al.

(10) Patent No.: US 10,072,477 B2
(45) Date of Patent: Sep. 11, 2018

(54) METHODS OF DEPLOYMENT FOR EUTECTIC ISOLATION TOOLS TO ENSURE WELLBORE PLUGS

(71) Applicant: Schlumberger Technology Corporation, Sugar Land, TX (US)

(72) Inventors: Iain Cooper, Sugar Land, TX (US); Mariano Sanchez, Houston, TX (US); Douglas PipChuk, Calgary (CA); Mohamed Sadek, Missouri City, TX (US); Dinesh Patel, Sugar Land, TX (US); Rashmi Bhavsar, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/957,261

(22) Filed: Dec. 2, 2015

(65) Prior Publication Data

US 2016/0319633 A1 Nov. 3, 2016

Related U.S. Application Data

(60) Provisional application No. 62/086,527, filed on Dec. 2, 2014.

(51) Int. Cl.
*E21B 33/12* (2006.01)
*E21B 33/134* (2006.01)
(Continued)

(52) U.S. Cl.
CPC ..... *E21B 33/134* (2013.01); *E21B 7/061* (2013.01); *E21B 17/1021* (2013.01); *E21B 23/04* (2013.01); *E21B 23/06* (2013.01); *E21B 23/065* (2013.01); *E21B 33/126* (2013.01); *E21B 33/1208* (2013.01); *E21B 33/129* (2013.01); *E21B 36/008* (2013.01); *E21B 36/04* (2013.01)

(58) Field of Classification Search
CPC ..... C09K 8/426; E21B 33/134; E21B 33/12; E21B 33/13; E21B 33/1204; E21B 33/1208
See application file for complete search history.

(56) References Cited

U.S. PATENT DOCUMENTS 6,384,389 B1 5/2002 Spencer
6,664,522 B2 12/2003 Spencer
(Continued)

FOREIGN PATENT DOCUMENTS

CA 2506508 10/2011
CA 2504877 7/2014
(Continued)

OTHER PUBLICATIONS

EP Application No. 15197619.8 Extended Search Report, dated Apr. 15, 2016, 8 pgs.

*Primary Examiner* — Zakiya W Bates

(57) ABSTRACT

A tool for deploying a wellbore plug in a well using flowable eutectic material is disclosed. A tool having a mandrel, an obstruction, and a flowable quantity of eutectic material in a solid state is positioned in the wellbore. The obstruction is actuated and the flowable material is heated to melt. The obstruction supports the flowed material as it cools to form a plug in the wellbore.

21 Claims, 9 Drawing Sheets

(51) Int. Cl.

| | |
|---|---|
| ***E21B 23/06*** | (2006.01) |
| ***E21B 7/06*** | (2006.01) |
| ***E21B 17/10*** | (2006.01) |
| ***E21B 23/04*** | (2006.01) |
| ***E21B 33/126*** | (2006.01) |
| ***E21B 33/129*** | (2006.01) |
| ***E21B 36/00*** | (2006.01) |
| ***E21B 36/04*** | (2006.01) |

(56) References Cited

U.S. PATENT DOCUMENTS

| | | | | |
|---|---|---|---|---|
| 6,926,083 | B2 | 8/2005 | La Rovere | |
| 6,942,032 | B2 | 9/2005 | La Rovere | |
| 7,152,657 | B2 * | 12/2006 | Bosma | E21B 29/10 164/80 |
| 7,285,762 | B2 | 10/2007 | Spencer | |
| 7,449,664 | B2 | 11/2008 | Spencer | |
| 7,455,104 | B2 | 11/2008 | Duhon et al. | |
| 7,934,552 | B2 | 5/2011 | La Rovere | |
| 8,151,895 | B1 | 4/2012 | Kunz | |
| 2006/0144591 | A1 * | 7/2006 | Gonzalez | E21B 29/10 166/277 |
| 2007/0199693 | A1 | 8/2007 | Kunz | |
| 2008/0105438 | A1 | 5/2008 | Jordan et al. | |
| 2013/0087335 | A1 | 4/2013 | Carragher et al. | |

FOREIGN PATENT DOCUMENTS

| | | | |
|---|---|---|---|
| GB | 2480869 | | 12/2011 |
| WO | 2001092682 | A1 | 12/2001 |
| WO | 2002027137 | A1 | 4/2002 |
| WO | 2003083255 | A1 | 10/2003 |
| WO | 2011073610 | A2 | 6/2011 |
| WO | 2014096857 | A1 | 6/2014 |

* cited by examiner

METHODS OF DEPLOYMENT FOR EUTECTIC ISOLATION TOOLS TO ENSURE WELLBORE PLUGS

CROSS REFERENCE TO RELATED APPLICATIONS

This application claims priority to U.S. Provisional Patent Application No. 62/086,527, filed on Dec. 2, 2014 entitled "METHODS OF DEPLOYMENT FOR EUTECTIC ISOLATION TOOLS TO ENSURE WELLBORE PLUGS, which is incorporated by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir.

SUMMARY

Certain embodiments of the present disclosure are directed to a wellbore plug deployment tool for use in a wellbore. The tool includes a mandrel having a proximate end and a distal end, the distal end being positioned further into the wellbore than the proximate end. The tool also includes a skirt at the distal end and an alloy sheath disposed on an outer surface of the mandrel. The alloy sheath is made of a eutectic material configured to melt when elevated to a predetermined high temperature and can reform at a predetermined low temperature. The tool also includes a temperature elevating mechanism configured to actuate to elevate the alloy sheath to the predetermined high temperature to melt the alloy sheath, and an obstruction coupled to the skirt and configured to support the molten alloy sheath such that upon reaching the predetermined low temperature the alloy sheath reforms to form a plug in the well. In some embodiments the tool also includes a centralizing mechanism coupled to the mandrel which is held in a retracted position as the wellbore plug deployment tool is run in hole and is exposed when the alloy melts and achieves an expanded position to centralize the wellbore plug deployment tool in the well.

In other embodiments the present disclosure is directed to a wellbore plug deployment tool wherein the temperature elevating mechanism comprises two or more sets of temperature elevating mechanisms in a predetermined arrangement around a circumference of the alloy sheath. Each set of temperature elevating mechanisms has a different predetermined ignition condition. In still further embodiments the wellbore plug deployment tool is used in a wellbore which is at least slightly deviated and the two or more sets of temperature elevating mechanisms are arranged in an azimuthal direction. A first set of the temperature elevating mechanisms is positioned at a portion of the wellbore nearest to the earth's core and is ignited first, and a second set of the temperature elevating mechanisms is positioned at a portion of the wellbore furthest to the earth's core and is ignited second.

Embodiments of the present disclosure are directed to a method of deploying a plug in a wellbore, including deploying a tool in the wellbore comprising a mandrel, an obstruction, and a flowable material. The flowable material will melt upon reaching a predetermined elevated temperature and reform upon cooling. The method also includes deploying the obstruction in the wellbore, activating the flowable material by elevating the flowable material to the predetermined elevated temperature, and allowing the flowable material to cool and reform supported by the obstruction to form the plug in the wellbore.

As used herein, the term "eutectic" is meant to refer to any material or composition which may be provided in a solid form and controllably heated to effectively liquefy and remove. This may include conventional soldering alloys suitable for downhole use. However, this may also include non-alloy compositions. The eutectic material may contain for example bismuth, lead, tin, cadmium, or indium. The eutectic material may expand when it is cooled and solidifies. The eutectic material may be melted for example by heating via various mechanisms, including without limitation heat delivery lines (e.g., electric lines), pyrotechnic devices and chemical reactions, for example thermite. The heating element or device may be disposed with the tubular string for activation when desired or run into the central passage when it is desired to liquefy a eutectic material.

In some embodiments the present disclosure is directed to methods and apparatuses that can be seen as extensions or modifications to the existing metal sealant and with added performance (horizontal capabilities) or enable new devices to be deployed (centralizers and other anchoring mechanisms).

Some existing technology will work well in vertical cases where gravity will assist with the placement of the metal sealant as it melts and subsequently cools further down the borehole as shown in FIG. 1. The initial solidification can then form a base for further metal build-up as the liquid metal runs down on top of the newly formed plug as shown in FIG. 2. This process eventually results in a gas-tight seal, with the whole annular space filled with solid metal. The expansion properties of the specific metals alloys are such that the plug applies a force to the casing or openhole in which it is constrained.

FIG. 3 shows a horizontal case including a mandrel 10, casing 12, and a slumped metal plug 14. In this case, the effect of gravity may cause slumping in the bottom part of the annulus with the result then being inadequate coverage in the upper part of the annulus. FIG. 4 shows a cross-sectional view of this phenomenon. The mandrel 10 Also, perhaps the tool/mandrel 10 will rest on the bottom side of the hole. This could also lead to poor coverage by the liquid metal on the narrow side of the annulus.

DETAILED DESCRIPTION

Figure 1:
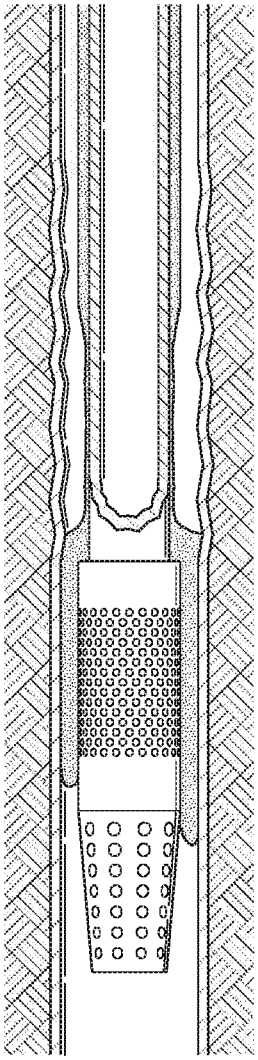
FIG. 1 (Prior Art)
FIG. 1 illustrates a Wel-lok metal-to-metal seal according to the prior art.
Figure 2:
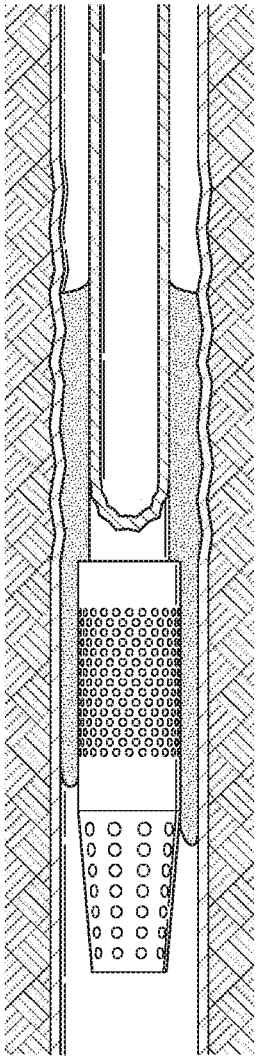
FIG. 2 (Prior Art)
FIG. 2 illustrates an initial deployment of a metal to metal seal according to the prior art.
Figure 3:
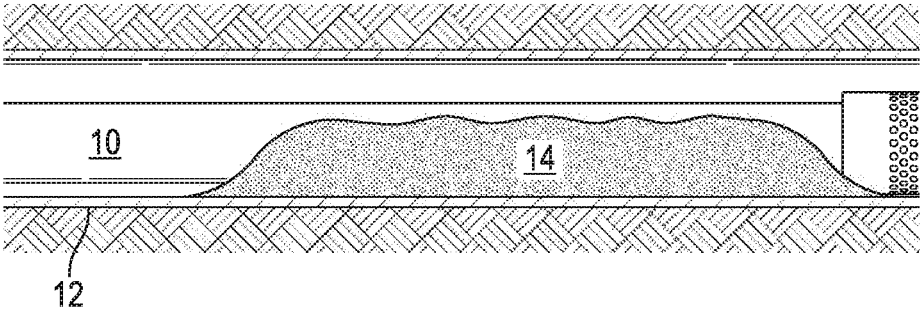
FIG. 3 (Prior Art)
FIG. 3 illustrates a slumped liquid metal in a highly deviated well according to the prior art.

In the following description, numerous details are set forth to provide an understanding of the present disclosure. However, it will be understood by those skilled in the art that the embodiments of the present disclosure may be practiced without these details and that numerous variations or modifications from the described embodiments may be possible.

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

The mechanism by which the basic tool deploys is such that the mandrel on which the alloy is 'stored' before heating is essentially a metal tube on which the metal is 'wrapped'. As the internals of the tool are heated, the alloy melts and the inner cylinder on which it was stored is now exposed. In some embodiments of the tool, this remains a cylinder. In other embodiments described below in Section 1, we now allow the inner cylinder on which the alloy is stored to become an active device. For example, one can envisage that components can be spring-loaded during the manufacturing process such that when the alloy is heated, melts and deploys, anchors, centralizers, or whipstocks could be automatically deployed. Each of these is described in turn below.

Figure 5A:
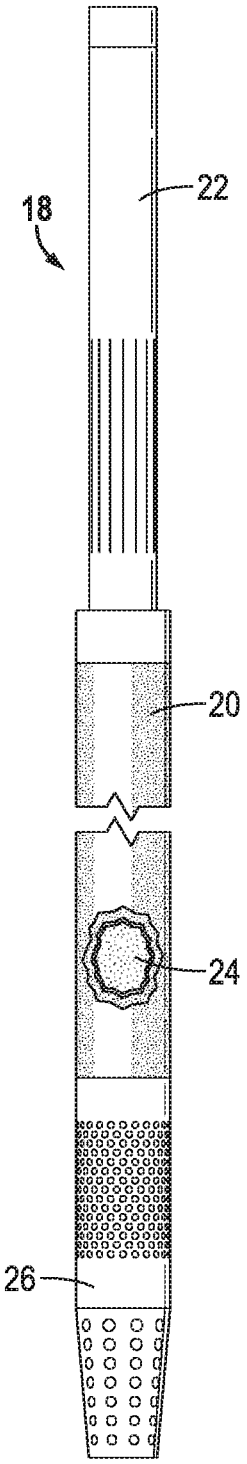
FIG. 5A illustrates embodiments of a wel-lok tool according to the present disclosure before installation.
Figure 4:
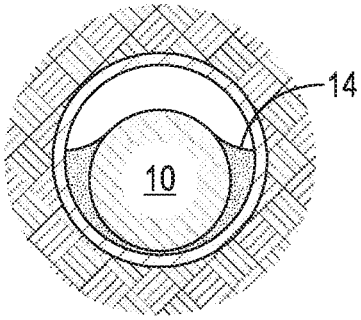
FIG. 4 (Prior Art)
FIG. 4 is a cross-sectional view of the slumped liquid metal depicted in FIG. 3 according to embodiments of the prior art.
Figure 5B:
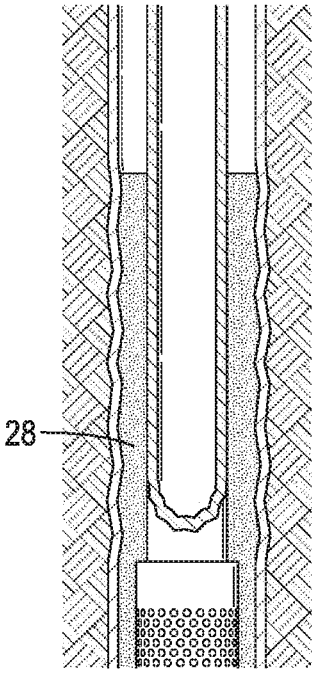
FIG. 5B illustrates embodiments of the wel-lok tool according to the present disclosure after forming the plug.

FIGS. 5A and 5B illustrate embodiments of a wel-lok tool according to the present disclosure. The Wel-Lok tool 18, according to embodiments, includes an alloy sheath 20 wrapped around a mandrel 22 that contains a thermite core 24. At the bottom of the tool 18 is a skirt 26. The skirt aids with cooling, collection, and build-up of the solidifying liquid metal formed when the alloy sheath 20 is melted.

Thermite in the thermite core 24 is ignited and burns at a predetermined rate so that the alloy melts and under gravity flow to the skirt 26, where it cools and builds up a plug 28. As the metal cools, the plug continues to grow as it accumulates more material, filling the annular gap into which the tool has been placed (FIG. 5B).

Section 1: Anchoring & Centralisation

As shown in FIGS. 5A and 5B, The metal alloy originally deployed as the sheath 24, swells upon solidifying as it cools, and it is this property that helps it anchor to the geometry in which it sits, and assist in providing some of the differential pressure holding capability across other support components, such as packers.

According to embodiments of the present disclosure, the alloy in the sheath 24 is typically a relatively simple two-component alloy, such as Bismuth and Germanium. It is suggested that improvements to the alloy can be made so that it improves its anchoring in the annular geometry, and can hold a potentially greater pressure differential across the set packer. In some embodiments, the alloy is mixed with fillers that can improve the frictional adherence to the inner wall, e.g., small sand particles that can add additional roughness to the surface.

Figure 6A:
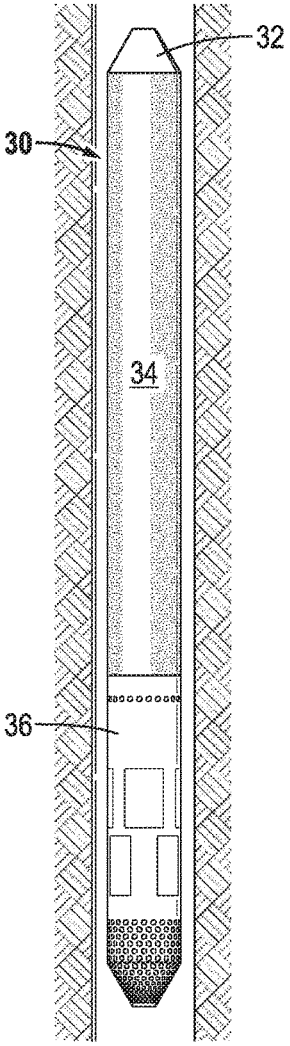
FIG. 6A illustrates a further embodiment of the present disclosure including expanding, biased arms in an un-deployed state.
Figure 6B:
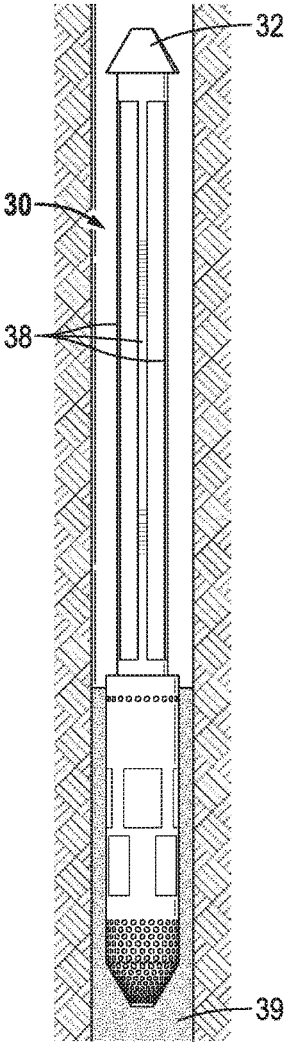
FIG. 6B illustrates a further embodiment of the present disclosure including expanding, biased arm after removal of covering material and before expansion.
Figure 6C:
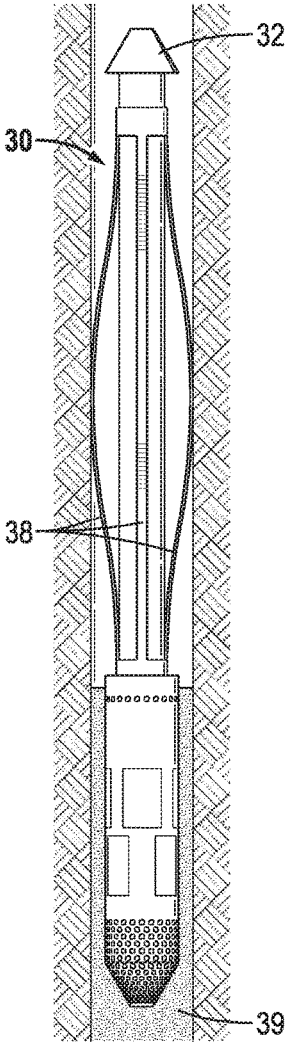
FIG. 6C illustrates a further embodiment of the present disclosure including expanding, biased arms after expanding.

In further embodiments the alloy can be formed in various other ways. FIGS. 6A-6C illustrate one such variant. The tool 30 includes a mandrel 32, an alloy sheath 34, and a skirt 36. During the manufacturing process, as the alloy sheath 24 is 'wrapped' or otherwise formed onto the mandrel 32. The mandrel 32 includes spring-loaded arms 38 extending a length of the mandrel 32 and being configured to extend radially when released. The alloy sheath 34 is formed on the mandrel 32 in such a way to cover and constrain the arms 38 in a recessed position. Once the alloy is melted it flows downward forming a plug 39, and exposing the arms 38 and freeing the arms 38 to expand to centralize the tool 30 in the hole. FIG. 6C shows the arms 38 in the radially expanded position.

Figure 7A:
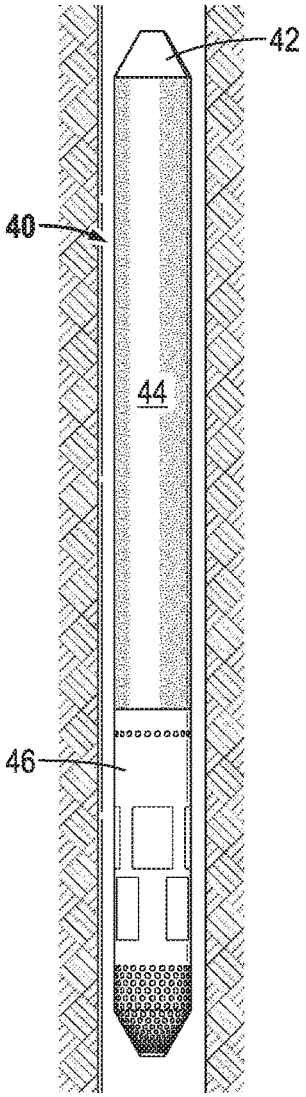
FIG. 7A illustrates yet another embodiment of the present disclosure including expandable slips in an un-deployed state.
Figure 7B:
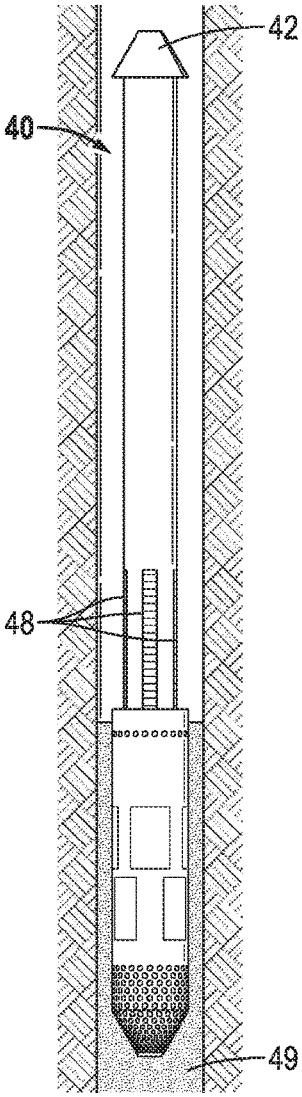
FIG. 7B illustrates yet another embodiment of the present disclosure including expandable slips after removal of covering material and before expanding.
Figure 7C:
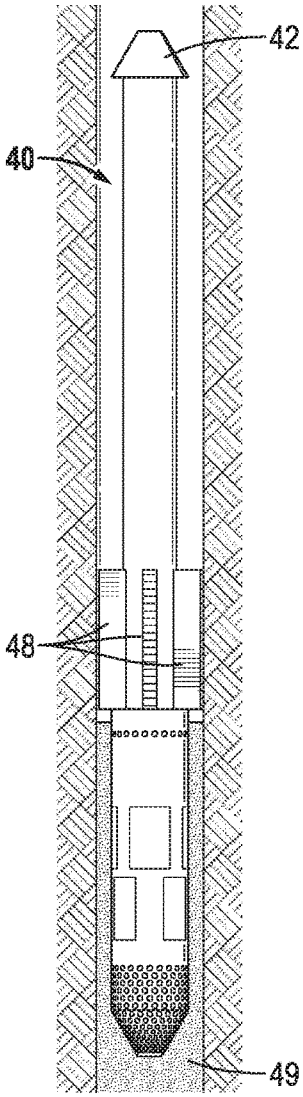
FIG. 7C illustrates yet another embodiment of the present disclosure including expandable slips after expanding.

FIGS. 7A-C illustrate yet another embodiment of the present disclosure. According to embodiments, a tool 40 includes a mandrel 42, an alloy sheath 44, and a skirt 46. In a manner similar to that described with respect to FIGS. 6A-C, the tool 40 also includes a plurality of slips 48 (FIG. 7B) which are covered by the alloy sheath 44 and exposed upon melting the alloy and forming the plug 49. The slips 48 can be spring-loaded, mechanically actuated, hydraulically, hydrostatically, or electrically actuated, or actuated by another suitable means of actuating slips, including coiled tubing or slick line. The slips 48 could have teeth or high friction surfaces to compound the adhesion.

Figure 8A:
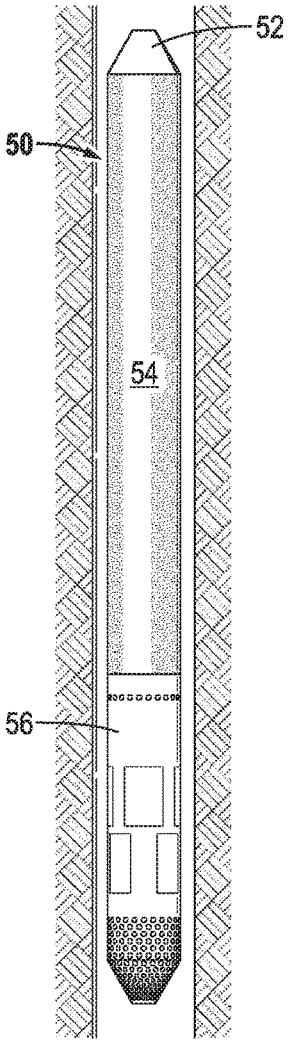
FIG. 8A illustrates yet another embodiment of the present disclosure including a whipstock before removing covering material.
Figure 8B:
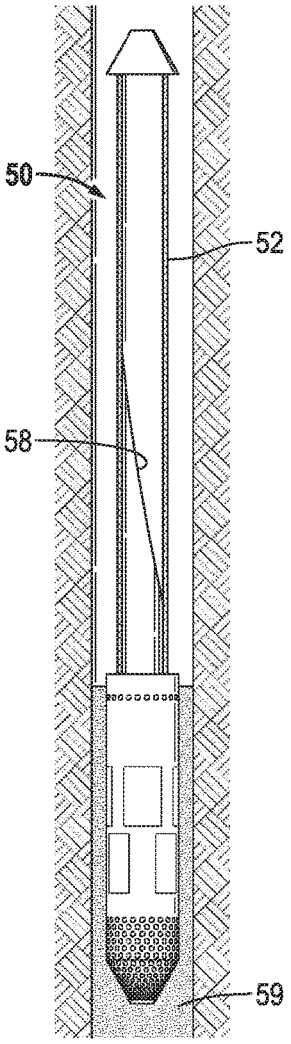
FIG. 8B illustrates yet another embodiment of the present disclosure including a whipstock after removing covering material.
Figure 8C:
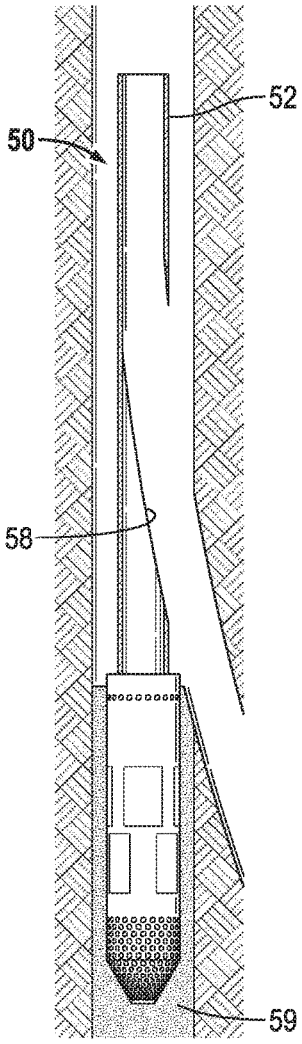
FIG. 8C illustrates yet another embodiment of the present disclosure including a whipstock after removing covering material and after deployment.

FIGS. 8A-C illustrate yet another embodiment of the present disclosure including a whipstock. FIG. 8A shows a tool 50 that includes a mandrel 52, an alloy sheath 54, and a skirt 56. The tool 50 includes a whipstock 58 (FIG. 8B) covered by the alloy sheath 54 and exposed by melting the alloy to form the plug 59. The whipstock 58 can be used to drill a secondary, lateral bore 57. This embodiment may use more liquid metal than a bridge plug application, and may require more precise control of the thermite core temperature to ensure that the full whipstock geometry can be revealed during the melting process. The melting alloy will have already bypassed the whipstock by the time it is fully deployed, and gives anchoring support below the whipstock deflection.

In some embodiments, a combination of the variants illustrated in FIGS. 6-8 can be created to achieve a very strongly anchored system in which slips are deployed below the whipstock and the solidifying metal forms a gas-tight and highly pressure-bearing plug below the slips and whipstock.

Section 2: Highly Deviated & Horizontal Deployment

Figure 9A:
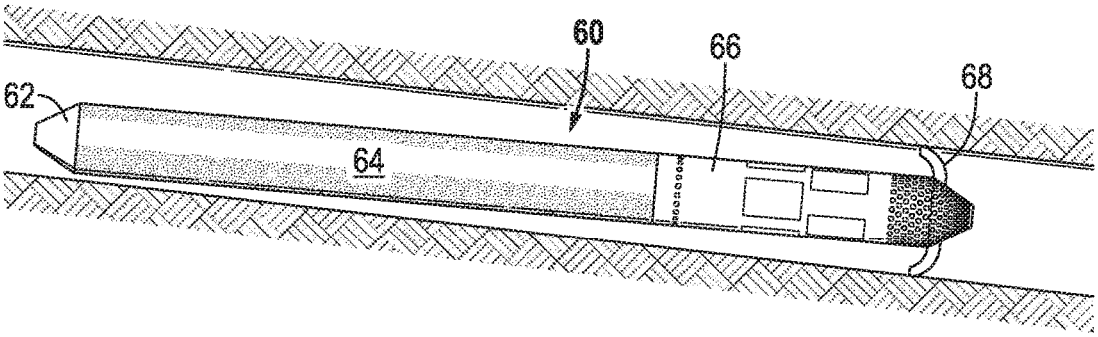
FIG. 9A illustrates an embodiment including a wider skirt to assist in forming the plug according to the present disclosure before melting eutectic material.
Figure 9B:
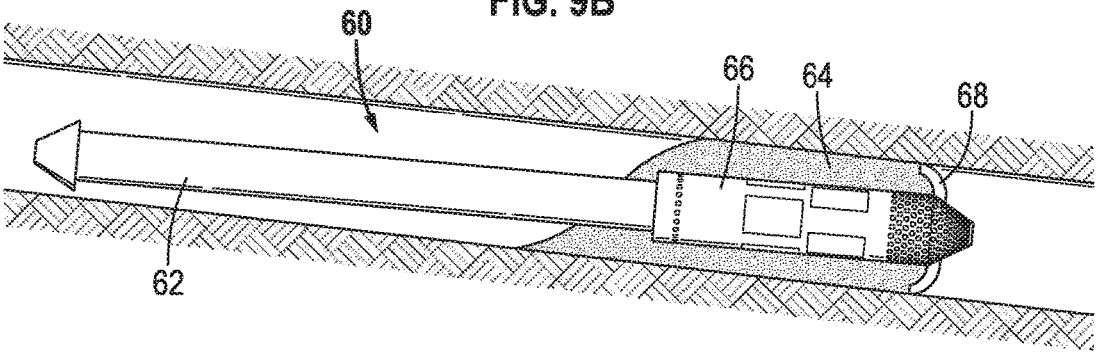
FIG. 9B illustrates an embodiment including a wider skirt to assist in forming the plug according to the present disclosure after melting eutectic material.

As indicated earlier, there is a possibility of not forming a fully gas-tight seal in a highly deviated or horizontal case. Indeed, slightly deviated may be more suitable as even limited gravity can be used to assist with the plug formation process. In the case of highly deviated & horizontal isolation, we may consider the following:

FIGS. 9A and 9B illustrate an embodiment including a wider skirt to assist in forming the plug according to the present disclosure. A tool 60 includes a mandrel 62, an alloy sheath 64, and a skirt 66. The skirt 66 can include a blocking apparatus 68, such as a cup packer, which is configured to expand to fill the hole before the alloy is melted. The melted alloy forms around the tool 60 and the blocking apparatus 68 allows the alloy to fill the well (FIG. 9B). This embodiment allows accurate calculation of the volume of liquid needed to fill a specific gap and to be able to hold the required pressure differential across the packer. It is also assumed there will be a certain amount of swelling of the eutectic material as it solidifies.

Figure 10A:
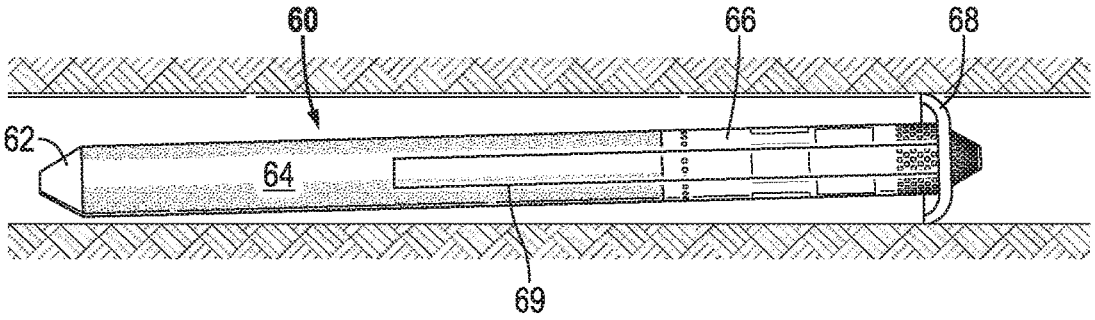
FIG. 10A shows yet another embodiment according to the present disclosure including a blocking apparatus and a mechanical shifting apparatus before shifting the shifting the apparatus.
Figure 10B:
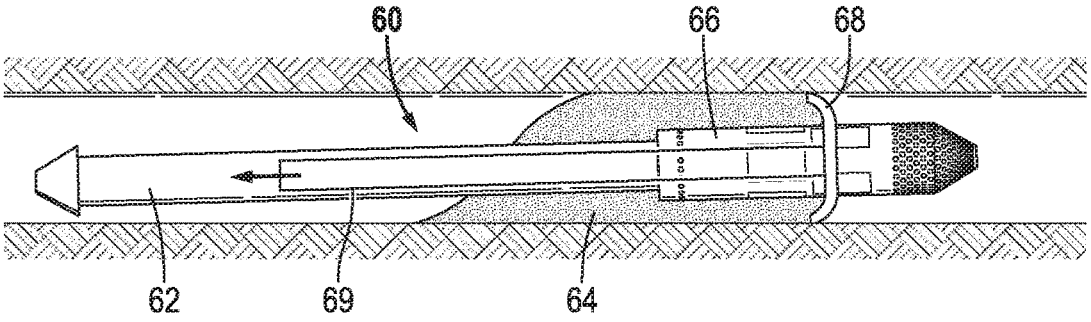
FIG. 10B shows yet another embodiment according to the present disclosure including a blocking apparatus and a mechanical shifting apparatus after shifting the apparatus.

FIGS. 10A and 10B show yet another embodiment according to the present disclosure including a blocking apparatus and a mechanical shifting apparatus. In the case of a perfectly horizontal section, or a section with negative slope (the system of FIGS. 9A and 9B above system may be good enough in all but a few degrees from horizontal), it may be advantageous to force the liquid metal such that we assist with both the rate of cooling and the vertical displacement of the packers. This could be achieved by expanding a cup packer, or having an already enabled cup packer on the wellbore toe side of the tool that one can pull into the metal as it is cooling. Using similar reference numerals as in FIGS. 9A and 9B, a tool 60 has a mandrel 62, a sheath 64, a skirt 66, and a blocking apparatus 68. The tool 60 also includes a shifting apparatus 69 configured to pull the blocking apparatus 68 in an upward (a direction toward the surface) direction as the liquid cools. The tool mandrel would have sufficient liquid metal as part of the sleeve such that even a small amount of leakage around the cups could be tolerated.

Figure 11A:
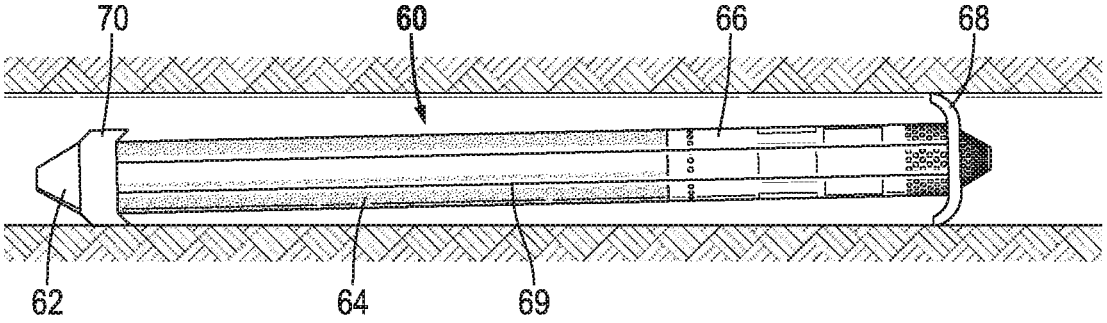
FIG. 11A shows an additional embodiment relative to that shown in FIGS. 10A and 10B according to the present disclosure in which a lower and an upper blocking apparatus are used.
Figure 11B:
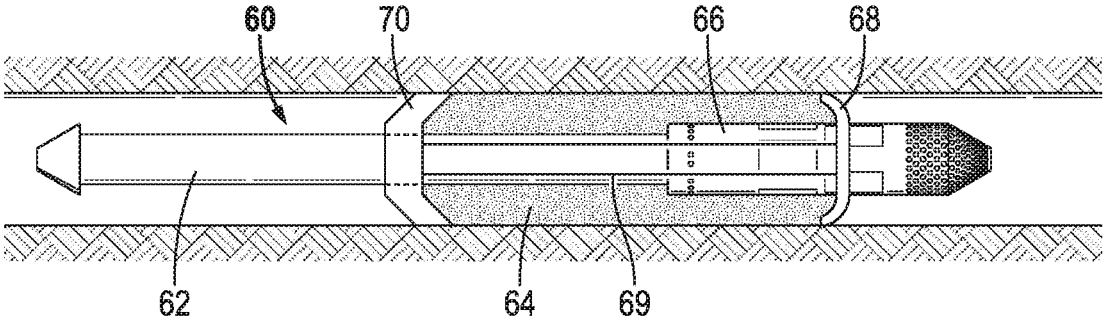
FIG. 11B shows an additional embodiment relative to that shown in FIGS. 10A and 10B according to the present disclosure in which the lower and upper blocking apparatuses are deployed.

FIGS. 11A and 11B show an additional embodiment relative to that shown in FIGS. 10A and 10B according to the present disclosure. In addition to the blocking apparatus 68, this embodiment includes a second blocking apparatus 70 positioned uphole from the alloy sheath 64. In some embodiments the second blocking apparatus 70 is configured to be shifted toward the first blocking apparatus 68. One, or the other, or both of the blocking apparatuses 68 and 70 can be moved inwardly to compress the molten alloy to form the plug.

Figure 12A:
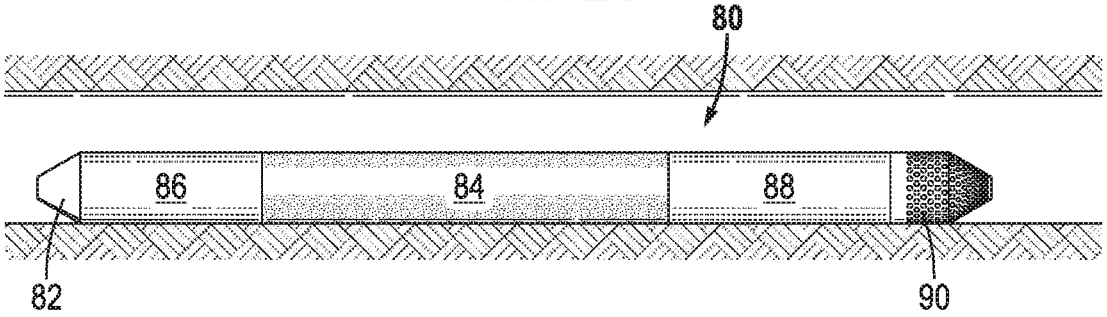
FIG. 12A shows another embodiment including two packers surrounding an alloy sheath according to embodiments of the present disclosure.
Figure 12B:
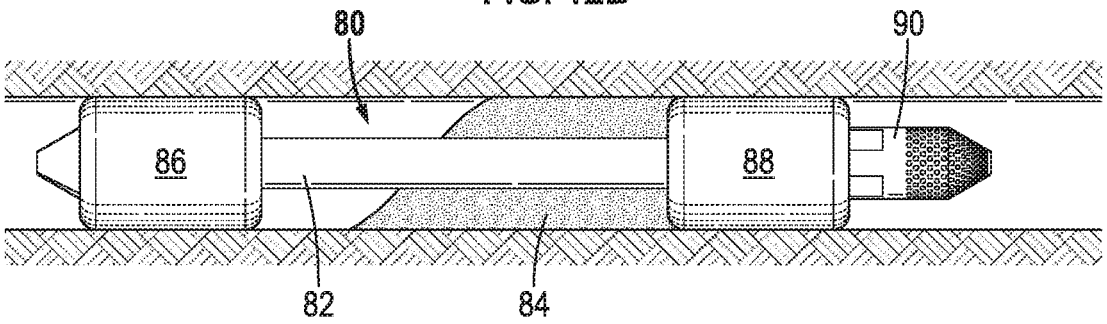
FIG. 12B shows another embodiment including two packers surrounding the alloy sheath of FIG. 12A with the packers in a deployed state.
Figure 13A:
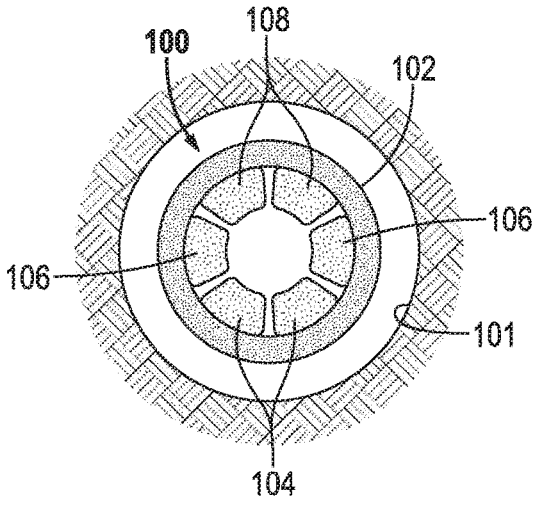
FIG. 13A shows an azimuthally graduated thermite core according to the present disclosure.
Figure 13B:
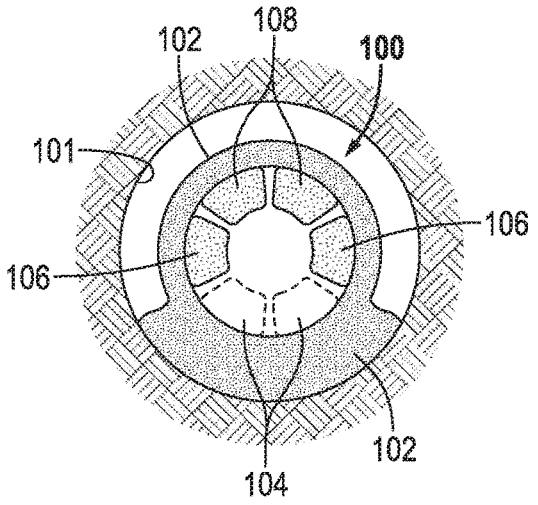
FIG. 13B shows an azimuthally graduated thermite core according to further embodiments of the present disclosure.
Figure 13C:
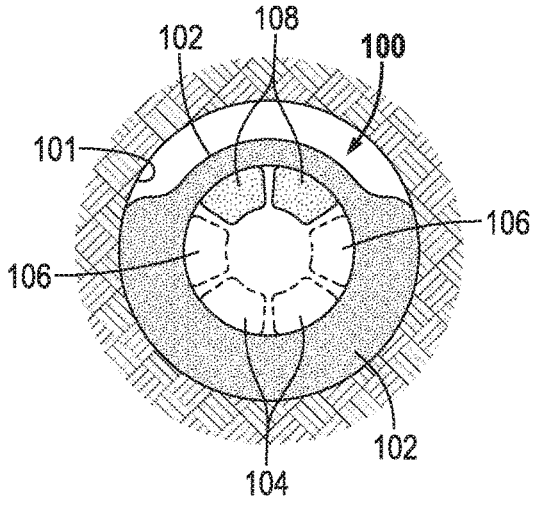
FIG. 13C shows an azimuthally graduated thermite core according to further embodiments of the present disclosure.
Figure 13D:
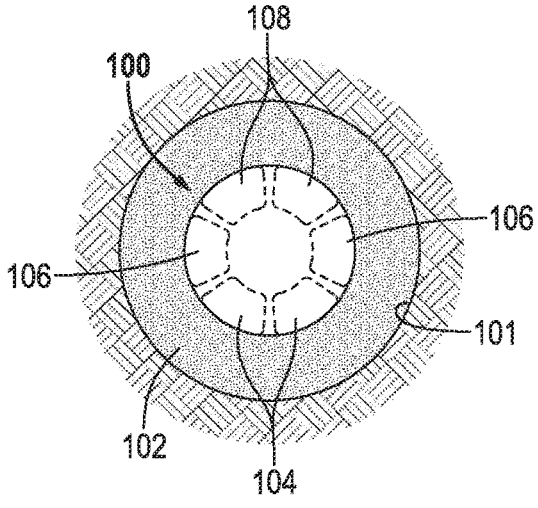
FIG. 13D shows an azimuthally graduated thermite core according to further embodiments of the present disclosure.

FIGS. 12A and 12B show another embodiment including two packers surrounding an alloy sheath according to embodiments of the present disclosure. A tool 80 includes a mandrel 82, an alloy sheath 84 disposed around the mandrel 82, a first packer 86 above the sheath 84, and a second packer 88 below the sheath 84, and a skirt 90. The tool 80 can be run into the hole with the packers 86, 88 unexpanded. When the tool 80 reaches the desired location, the packers 86, 88 can be set, then the alloy sheath 84 can be actuated to melt and form the plug between the packers 86, 88. The packers 86, 88 can be any suitable type of packer, including an inflatable packer, swellable packer, mechanical packer, etc. The skirt 90 and mandrel 82 can include any of the features described above with reference to earlier figures.

In another embodiment, to ensure that the full annular gap is completely covered by metal sealant is to try and control the rate of melting and cooling to ensure that a good bed of liquid metal is built up and then build up the seal on top of that. This can be achieved in several ways:

FIGS. 13 A-D show an azimuthally graduated thermite core according to the present disclosure. The tool 100 includes an alloy sheath 102, and thermite cores placed within the sheath and configured to actuate to melt the alloy sheath 102 (FIG. 13A). The thermite cores include first cores 104 placed nearest the bottom of the wellbore 101, a second set of thermite cores 106 higher up in the wellbore 101, and a third set of thermite cores 108 highest. The thermite cores can be ignited from lowest to highest to ensure a proper melting and deployment of the alloy. The formulation of the metal is such that it rapidly cools and sets before it has a chance to slump over too great a zone horizontally. Then the 'middle' portion of the thermite 106 is ignited to ensure that the metal adjacent to this zone melts and forms on top of the already cooling lower section (FIG. 13C). Finally the top portion is melted, and is deposited on top of the intermediate and lower layers (FIG. 13D). The quantity of metal and thermite can be chosen to ensure there is enough to form a good plug.

In another embodiment, the alloy 102 of the tool can be varied in the azimuth sense with a first type of alloy positioned near the first thermite cores 104, a second type of alloy near the second thermite cores 106, and a third type can be positioned near the third thermite cores 108. Two, three, four, or more types of alloys can be used. The alloys can have differing melting temperatures, pressure ratings, set temperatures, or can vary in another characteristic. Another method of forming a plug is to have alloys of differing melting points arranged on the exterior of the mandrel, and then structure the thermite in the interior of the tool to ignite at different temperatures, so that as above, the bottom section melts first and forms a plug, and the subsequently the middle and upper surfaces are melting. In both of these cases we may need to know the orientation of the tool, so appropriate sensors (inclinometers, magnetometers etc.) may be used to ensure placement with the correct orientation that is conducive to the optimum creation and placement of the plug. The tool can have two, three, or more stages as needed.

Figure 14A:
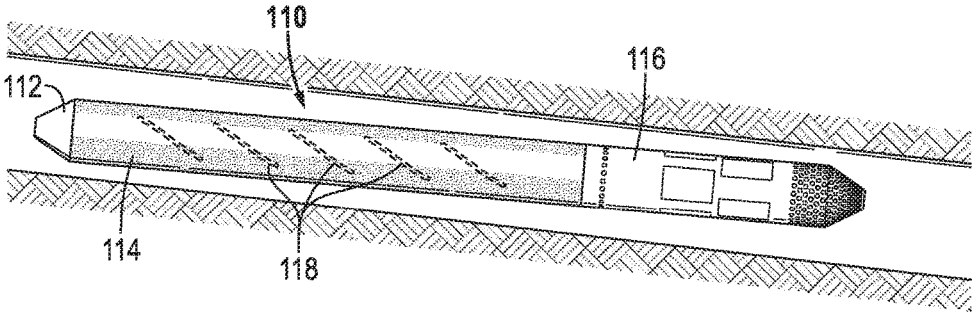
FIG. 14A shows yet another embodiment including vanes according to the present disclosure.
Figure 14B:
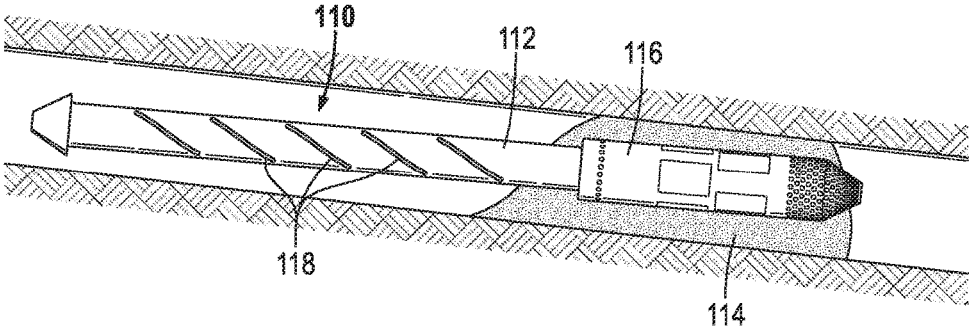
FIG. 14B shows yet another embodiment including vanes according to the present disclosure.

FIGS. 14A and 14B show yet another embodiment including vanes according to the present disclosure. A tool 110 includes a mandrel 112, an alloy sheath 114, a skirt 116, and a plurality of vanes 118 disposed under the alloy sheath 114. When the alloy sheath 114 is melted (by thermite cores or by another suitable method) the liquid metal flow is directed by the vanes 118. The shape, size, number, and angle of the vanes 118 can vary to direct the liquid metal where it is desired to flow, and can take into account the degree of deviation of the well.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A wellbore plug deployment tool for use in a wellbore, comprising:

a mandrel having a proximate end and a distal end, the distal end being positioned further into the wellbore than the proximate end;

a skirt at the distal end;

an alloy sheath disposed on an outer surface of the mandrel, wherein the alloy sheath is made of a eutectic material configured to melt when elevated to a predetermined high temperature and can reform at a predetermined low temperature;

a temperature elevating mechanism configured to actuate to elevate the alloy sheath to the predetermined high temperature to melt the alloy sheath, wherein the alloy sheath comprises two or more sets of alloy material regions having different material properties such that ignition of a first set of alloy material can be achieved separate from ignition of a second set of alloy material; and an obstruction coupled to the skirt and configured to support the molten alloy sheath such that upon reaching the predetermined low temperature the alloy sheath reforms to form a plug in the well.

2. The wellbore plug deployment tool of claim 1, further comprising a centralizing mechanism coupled to the mandrel, wherein the centralizing mechanism is held in a retracted position as the wellbore plug deployment tool is run in hole and is exposed when the alloy melts and achieves an expanded position to centralize the wellbore plug deployment tool in the well.

3. The wellbore plug deployment tool of claim 2 wherein the centralizing mechanism comprises slips.

4. The wellbore plug deployment tool of claim 3 wherein the slips are actuated by at least one of a hydraulic, hydrostatic, electric, swellable, inflatable, and mechanical actuator.

5. The wellbore plug deployment tool of claim 2 wherein the centralizing mechanism comprises elongated biasing arms which are biased toward the expanded position and are held in the retracted position by the alloy sheath.

6. The wellbore plug deployment tool of claim 2 wherein the obstruction comprises a whipstock.

7. The wellbore plug deployment tool of claim 1 wherein the obstruction comprises a cup packer.

8. The wellbore plug deployment tool of claim 1, further comprising a shifting mechanism configured to move the obstruction toward the proximal end of the wellbore plug deployment tool as the molten alloy reforms.

9. The wellbore plug deployment tool of claim 1 wherein the obstruction comprises a distal obstruction and a proximal obstruction, wherein the alloy sheath is disposed between the proximal and distal obstructions.

10. The wellbore plug deployment tool of claim 9, further comprising a shifting mechanism configured to move at least one of the distal and proximal obstructions to reduce a distance between the proximal and distal obstructions to form a plug.

11. The wellbore plug deployment tool of claim 9 wherein at least one of the proximal and distal obstructions comprises a packer.

12. The wellbore plug deployment tool of claim 1 wherein the temperature elevating mechanism comprises two or more sets of temperature elevating mechanisms in a predetermined arrangement around a circumference of the alloy sheath, wherein each set of temperature elevating mechanisms has a different predetermined ignition condition.

13. The wellbore plug deployment tool of claim 12 wherein:

the wellbore plug deployment tool is configured for use in a wellbore which is at least slightly deviated;

the two or more sets of temperature elevating mechanisms are arranged in an azimuthal direction; and a first set of the temperature elevating mechanisms is positioned at a portion of the wellbore nearest to the earth's core and is ignited first;

a second set of the temperature elevating mechanisms is positioned at a portion of the wellbore furthest to the earth's core and is ignited second.

14. The wellbore plug deployment tool of claim 1 wherein the temperature elevating mechanism comprises thermite cores.

15. A method of deploying a plug in a wellbore, comprising:

deploying a tool in the wellbore comprising a mandrel, an obstruction, and a flowable material, wherein the flowable material is disposed on an outer surface of the mandrel and configured to melt upon reaching a predetermined elevated temperature and reform upon cooling;

deploying the obstruction in the wellbore;

activating the flowable material by elevating the flowable material to the predetermined elevated temperature, wherein the flowable material comprises two or more sets of alloy material regions having different material properties such that ignition of a first set of alloy material can be achieved separate from ignition of a second set of alloy material; and allowing the flowable material to cool and reform supported by the obstruction to form the plug in the wellbore.

16. The method of claim 15 wherein deploying the obstruction in the wellbore comprises setting slips.

17. The method of claim 15 wherein deploying the obstruction in the wellbore comprises setting a packer.

18. The method of claim 15 wherein deploying the obstruction in the wellbore comprises moving the obstruction along the wellbore to form the flowable material while the flowable material is at least partially molten.

19. The method of claim 15, further comprising centralizing the tool in the wellbore by flowing the flowable material to expose biasing arms, allowing the biasing arms to move to an expanded state to centralize the tool in the wellbore.

20. The method of claim 15 wherein activating the flowable material comprises at least one of igniting thermite, providing electric energy to the flowable material, and providing chemical energy to the flowable material.

21. A wellbore plug deployment tool for use in a wellbore, comprising:

a mandrel having a proximate end and a distal end, the distal end being positioned further into the wellbore than the proximate end;

a skirt at the distal end;

an alloy sheath disposed on an outer surface of the mandrel, wherein the alloy sheath is made of a eutectic material configured to melt when elevated to a predetermined high temperature and can reform at a predetermined low temperature;

a temperature elevating mechanism configured to actuate to elevate the alloy sheath to the predetermined high temperature to melt the alloy sheath, wherein the temperature elevating mechanism comprises two or more sets of temperature elevating mechanisms in a predetermined arrangement around a circumference of the alloy sheath, wherein each set of temperature elevating mechanisms has a different predetermined ignition condition; and an obstruction coupled to the skirt and configured to support the molten alloy sheath such that upon reaching the predetermined low temperature the alloy sheath reforms to form a plug in the well.

* * * * *